United States Patent [19]

Ishii et al.

[11] Patent Number: 4,928,358

[45] Date of Patent: May 29, 1990

[54] PULL TAB FOR SLIDE FASTENER SLIDERS

[75] Inventors: Susumu Ishii, Kurobe; Hideyuki Matsushima, Toyama, both of Japan

[73] Assignee: Yoshida Kogyo K.K., Tokyo, Japan

[21] Appl. No.: 307,959

[22] Filed: Feb. 9, 1989

[30] Foreign Application Priority Data

Feb. 12, 1988 [JP] Japan ..... 63-17787[U]

[51] Int. Cl.[5] ..... A44B 19/26

[52] U.S. Cl. ..... 24/431; 24/419; 24/429; 428/246

[58] Field of Search ..... 24/431, 419, 429; 294/3.6; 428/246

[56] References Cited

U.S. PATENT DOCUMENTS

| | | | |
|---|---|---|---|
| 1,752,111 | 3/1930 | Rutherford . | |
| 2,147,571 | 2/1939 | Carlile . | |
| 2,185,853 | 1/1940 | Knoess | 24/431 |
| 2,232,756 | 2/1941 | Marcus | 24/431 |
| 2,292,484 | 8/1942 | Schwartz | 24/431 |
| 2,299,846 | 10/1942 | Poux . | |
| 2,497,740 | 2/1950 | Poux | 294/3.6 |
| 3,583,044 | 6/1971 | Howell | 24/431 |
| 4,515,852 | 5/1985 | Katabe et al. | 428/246 |

FOREIGN PATENT DOCUMENTS

| | | | |
|---|---|---|---|
| 60-912 | 4/1985 | Japan | 24/429 |
| 62-102407 | 6/1987 | Japan . | |

*Primary Examiner*—Victor N. Sakran

*Attorney, Agent, or Firm*—Hill, Van Santen, Steadman & Simpson

[57] ABSTRACT

A pull tab for slide fastener sliders includes a soft elastic grip mound provided on the grip portion of a pull tab body and projecting from one of front and rear surfaces of the pull tab body. The grip mound has a roughened outer surface to increase the resistance to slip and is elastically deformable to fit the shape of the user's finger when the grip portion is gripped. With the grip mound thus provided, the pull tab can be gripped stably and reliably by the user's fingers, which ensures a smooth opening and closing operation of a slide fastener.

6 Claims, 2 Drawing Sheets

PULL TAB FOR SLIDE FASTENER SLIDERS

BACKGROUND OF THE INVENTION

1. Field of the Invention:

The present invention relates generally to a slider for a slide fastener attached to a bag or the like article, and more particularly to a pull tab for such slide fastener slider.

2. Description of the Prior Art:

A typical pull tab for slide fastener sliders of the type described is disclosed in Japanese Utility Model Laid-open Publication No. 62-102407. The disclosed pull tab includes, as reillustrated here in FIG. 5, a pull tab body 11 formed of a highly flexible and elastic material such as soft synthetic rubber, soft synthetic resin, etc. and having a grip portion 12*b* on which a plurality of parallel spaced transverse ridges 13 are formed at equal intervals.

As is well known in the art, the pull tab is a part of a slider which is used to open and close a slide fastener, the grippability or "easy-to-grip" capability is an important characteristic required for the slider pull tab to ensure a smooth opening and closing operation of the slide fastener.

The slider pull tab disclosed in the above-mentioned Japanese publication is soft and elastic due to its material used, however, it is still unsatisfactory in terms of the grippability. This is because the ridges 13 on the grip portion 12 in fact provide an increased resistance to slip but concurrently give an unpleasant rugged touch to feeling onto the user's fingers.

SUMMARY OF THE INVENTION

With the foregoing difficulties in view, it is therefore an object of the present invention to provide a pull tab for a slide fastener slider, which has an improved easy-to-grip capability while retaining the necessary non-slip characteristic.

According to the present invention, there is provided a pull tab for slide fastener sliders which includes at least one soft elastic grip mound provided on the grip portion of a pull tab body and raising from one of front and rear surfaces of the pull tab body. The grip mound has a roughened outer surface and is elastically deformable to fit the shape of the user's finger when the grip portion is gripped.

With the construction, when the user grips the grip portion of the pull tab for moving the slider to open and close a slide fastener, the grip mound is elastically flexed or deformed into a shape complementary in contour to the shape of the user's finger. In this instance, the roughened outer surface of the grip mound provides an increased resistance to slip and gives a pleasant touch or feeling to the user's fingers.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
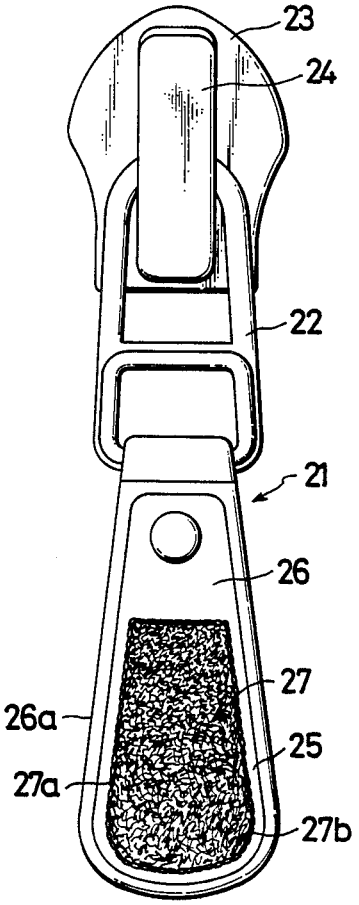
FIG. 1 is a front elevational view of a slide fastener slider incorporating a pull tab according to the present invention.
Figure 2:
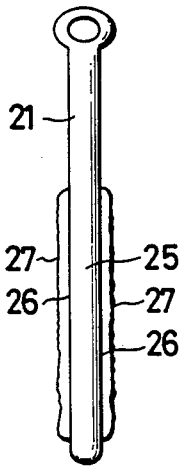
FIG. 2 is a side view of the pull tab.
Figure 3:
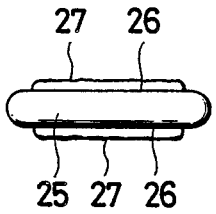
FIG. 3 is a bottom view of the pull tab.

FIGS. 1 through 3 show a slider pull tab embodying the present invention. The slider pull tab includes an elongate body 21 formed of a soft elastic material such as soft synthetic rubber or soft synthetic resin and is connected at its proximal end to a connector 22 by means of which the pull tab body 21 is pivotally connected to a support lug 24 on a slider body 23 in a manner known per se. The pull tab body 21 includes a grip portion 25 constituting a major part of the pull tab body 21 and extending from an intermediate portion near the proximal end to the distal end of the pull tab body 21. The grip portion 25 includes a pair of substantially rectangular grip mounds 27, 27 raised from front and rear surfaces 26, 26 of the pull tab body 21. The grip mounds 27 have respective peripheral walls 27*a* (FIG. 1) spaced inwardly or offset from the peripheral edge 26*a* of the pull tab body 21 and extending substantially parallel to the peripheral edge 26*a* of the pull tab body 21. The grip mounds 27 are formed integrally with the pull tab body 21 and hence possess an adequate degree of elasticity. The grip mounds 27 have roughened outer surfaces 27*b* (FIG. 1) bearing on their entire areas a suitble design pattern such as a wrinkle finish pattern, a satin-like finish pattern, or a ribbed pattern.

With the grip mounds 27 thus provided, the grip portion 25 is thicker than the pull tab body 21 and has an adequate degree of elasticity. When gripped by the user's fingers, the grip mounds 27 are elastically deformed to conform to the shape of the user's fingers. In this instance, the respective roughened outer surfaces of the grip mounds 27 provide an increased resistance to slip and give a pleasant touch or feeling to the user's fingers, thus ensuring a stable and reliable gripping of the pull tab which leads to a smooth opening and closing operation of a slide fastener (not shown). The design pattern formed on the roughened surfaces 27*b* provides a leather-like appearance and hence the aesthetic appearance of the pull tab is improved as a whole.

Figure 4:
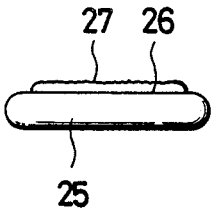
FIG. 4 is a view similar to FIG. 3, but showing a modified form of the pull tab.
Figure 5:
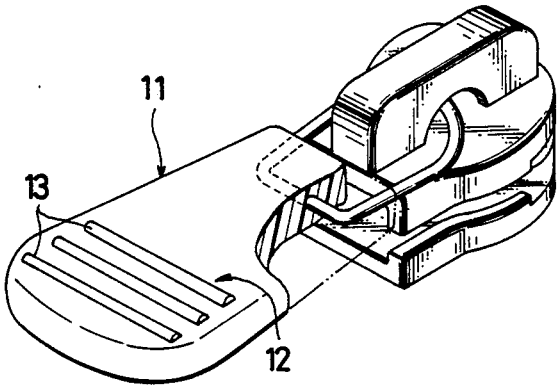
FIG. 5 PRIOR ART
FIG. 5 is a perspective view, view part shown in cross section, of a slide fastener slider having a prior art pull tab.

In the embodiment described above, the grip portion 25 has a mound 27 provided on each surface of the pull tab body 21. The present invention is not limited to this embodiment but rather includes another embodiment shown in FIG. 4 in which the grip portion has a single grip mound 27 provided only one surface of the pull tab body. The single grip mound 27 preferably is disposed on the front surface of the pull tab body, mainly from the aesthetic veiwpoint.

Obviously, various modifications and variations of the present invention are possible in the light of the above teaching. It is therefore to be understood that within the scope of the appended claims the invention may be practiced otherwise than as specifically described.

What is claimed is:

1. A pull tab for slide fastener sliders of the type having a one-piece pull tab body formed of a soft elastic material such as soft synthetic rubber or soft synthetic resin, and pivotally connected to a support lug on a slider body by means of a connector, said one-piece pull tab body having an integral grip portion for being gripped by the user's fingers and constituting a major part of said pull tab body, wherein the improvement comprises: a single soft elastic grip mound provided integrally on said grip portion and raising from at least one of front and rear surfaces of said pull tab body, said grip mound having a roughened outer surface of a leather-like appearance and being elastically deformable to fit the shape of the user's finger when said grip portion is gripped, said grip mound being inwardly spaced from an outer peripheral edge of said pull tab body and having an outer peripheral wall extending substantially parallel to said outer peripheral edge of said pull tab body.

2. A pull tab according to claim 1, said grip mound being disposed on a front surface of said pull tab body.

3. A pull tab according to claim 1, said grip mound being disposed on each of said front and rear surfaces of said pull tab body.

4. A pull tab according to claim 1, said roughened outer surface having a design pattern comprising a wrinkle-finish pattern.

5. A pull tab according to claim 1, said roughened outer surface having a design pattern comprising a satin-like finish pattern.

6. A pull tab according to claim 1, said roughened outer surface having a design pattern comprising a ribbed pattern.

* * * * *